US005518179A

United States Patent [19]

Humberstone et al.

[11] Patent Number: 5,518,179

[45] Date of Patent: May 21, 1996

[54] FLUID DROPLETS PRODUCTION APPARATUS AND METHOD

[75] Inventors: Victor C. Humberstone; Guy C. F. Newcombe; Andrew J. Sant; Mathew R. Palmer, all of Cambridge, United Kingdom

[73] Assignee: The Technology Partnership Limited, Hertfordshire, United Kingdom

[21] Appl. No.: 244,302

[22] PCT Filed: Dec. 4, 1992

[86] PCT No.: PCT/GB92/02262

§ 371 Date: May 26, 1994

§ 102(e) Date: May 26, 1994

[87] PCT Pub. No.: WO93/10910

PCT Pub. Date: Jun. 10, 1993

[30] Foreign Application Priority Data

| | | | |
|---|---|---|---|
| Dec. 4, 1991 | [GB] | United Kingdom | 9125763 |
| Apr. 21, 1992 | [GB] | United Kingdom | 9208516 |
| Apr. 28, 1992 | [GB] | United Kingdom | 9209113 |

[51] Int. Cl.[6] ..... B05B 1/08

[52] U.S. Cl. ..... 239/102.2

[58] Field of Search ..... 239/102.2, 102.1, 239/4

[56] References Cited

U.S. PATENT DOCUMENTS

| | | | |
|---|---|---|---|
| 3,812,854 | 5/1974 | Michaels et al. | 239/102.2 X |
| 4,036,919 | 7/1977 | Komendowski et al. | 261/122 |
| 4,533,082 | 8/1985 | Maehara et al. | 239/102.2 |
| 5,152,456 | 10/1992 | Ross et al. | 239/102.2 |

FOREIGN PATENT DOCUMENTS

| | | | |
|---|---|---|---|
| 84458 | 7/1983 | European Pat. Off. | 239/102.2 |
| 0432992A1 | 10/1990 | European Pat. Off. . | |
| 0480615A1 | 1/1991 | European Pat. Off. . | |
| 516565 | 12/1992 | European Pat. Off. | 239/102.2 |
| 3434111A1 | 9/1984 | Germany . | |
| 3734905A1 | 10/1987 | Germany . | |
| 2041249 | 6/1979 | United Kingdom . | |
| 2272389 | 5/1994 | United Kingdom | 239/102.2 |

*Primary Examiner*—Andres Kashnikow
*Assistant Examiner*—Lesley D. Morris
*Attorney, Agent, or Firm*—Watson Cole Stevens Davis

[57] ABSTRACT

A fluid droplet production apparatus, for example, for use an atomizer spraying device, has a membrane which is vibrated by an actuator, which has a composite thin-walled structure and is arranged to operate in a bending mode. Fluid is supplied directly to a surface of the membrane, as fluid is sprayed therefrom on vibration of the membrane.

15 Claims, 11 Drawing Sheets

FLUID DROPLETS PRODUCTION APPARATUS AND METHOD

Figure 1:
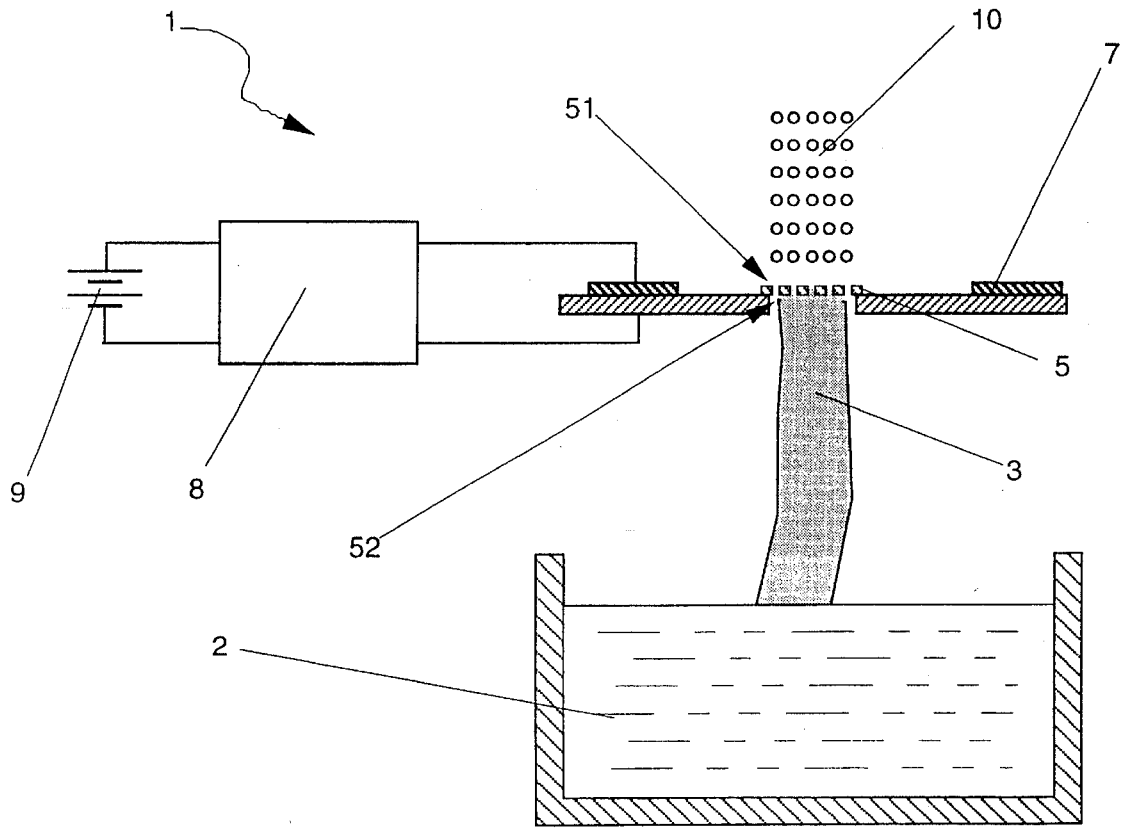

This invention relates to apparatus and methods for the production of droplets of fluid, liquids or liquid suspensions (hereinafter called 'fluids' or 'liquids'), by means of an electromechanical actuator (preferably an electroacoustical actuator).

It is known to produce fine droplet sprays, mists or aerosols (hereinafter called 'sprays') by the action of high frequency mechanical oscillations upon a liquid at its surface with ambient air or other gases. Prior art of possible relevance includes the following patent specifications: GB-A-2041249, US-A-3812854, US-A-4036919, DE-A-3434111, DE-A-3734905, US-A-4533082, EP-A-0432992 & EP-A-0480615, and *Physical Principles of Ultrasonic Technology* by Rozenberg, published in Plenum.

In some instances (e.g. DE-A-3734905 & US-A-3812854) the liquid-gas surface is several millimeters away from a source of mechanical oscillations placed within the liquid and the aerosol is created by the action of these oscillations propagated as sound waves that pass through the liquid to the liquid surface. In some such cases (e.g. US-A-3812854) the liquid-gas surface is constrained by a porous medium.

In other cases (e.g. GB-A-2041249) the liquid is in the form of a thin film on a non-porous membrane which itself is driven by a similarly remote source of mechanical oscillations.

These methods generally have low efficiency of energy utilisation in the production of the droplet spray or are of relatively high manufacturing cost.

In yet other cases (e.g. US-A-4533082) the source of mechanical oscillations is closely adjacent to a porous membrane and the excitation passes directly from the source to the porous membrane. This method improves efficiency to some degree, but the apparatus remains a relatively complex assembly and has a relatively limited range of operating conditions. For example, it requires a fluid chamber.

In still other cases (e.g. EP-A-0431992) improvements in efficiency are sought by coupling the vibrating means to a perforate member by mean of an annular member having a relatively thinner annular portion connected to the perforate membrane and a relatively thicker outer annular portion connected to the vibrating means. This member is claimed to act as an impedance transformer whereby relatively small amplitudes of acoustic vibration of the vibrating means are amplified prior to their transmission into the perforate member. This specification discloses the use of additional components (for example, a fluid chamber) and also has a relatively limited range of operation conditions.

It is known from US-A-4533082 and from EP-A-0432992 to provide dispensing apparatus comprising a housing defining a chamber receiving in use a quantity of liquid to be dispensed, the housing comprising a perforate membrane which defines a front wall of the chamber and which has a rear face contacted by liquid in use, the apparatus further comprising vibrating means connected to the housing and operable to vibrate the perforate membrane to dispense 26 droplets of liquid through the perforate membrane.

US-A-4533082, discloses a fluid droplet production apparatus with a membrane and a piezo-electric actuator that contracts and expands in order to drive the membrane.

An object of the present invention is to overcome the various problems associated with the prior art apparatus land methods and, specifically, to improve the simplicity of the device.

According to a first aspect of the present invention there is provided fluid droplet production apparatus comprising:

a membrane;

an actuator, for vibrating the membrane, the actuator comprising a composite thin-walled structure arranged to operate in a bending mode and to vibrate the membrane substantially in the direction of actuator bending; and means for supplying fluid directly to a surface of the membrane, as fluid is sprayed therefrom on vibration of the membrane.

Thus, the membrane is structured so as to influence the menisci of fluid introduced to the membrane.

Preferably, the actuator is substantially planar, but it is envisaged that thin-walled curved structures may be appropriate in some circumstances. Another thin-walled structure which is not planar, would be a structure having bonded layers in which the stiffness of each layer varied across the common face area over which they are bonded in substantially the same way. In all cases, the actuator is thin-walled over its whole area.

Fluid is brought from a fluid source directly into contact with the membrane (which may be tapered in thickness and/or have a textured surface) and is dispensed from the membrane by the operation of the vibration means, (advantageously without the use of a housing defining a chamber of which the membrane is a part).

The membrane may be a perforate membrane, in which case the front face may have annular locally raised regions disposed substantially concentrically with the holes.

One advantage of the arrangement of the invention is that a relatively simple and low cost apparatus may be used for production of a fluid droplet spray.

A second advantage of this arrangement is that simple and low cost apparatus can provide a relatively wide range of geometrical layout arrangements of the fluid source relative to the assembly of membrane and vibrating means.

A third advantage of this arrangement is that inertial mass and damping provided by fluid and acting to restrain the dispensing of fluid as droplets can be reduced by the absence of a reservoir of liquid against the membrane (in the form of a housing defining a chamber which receives in use a quantity of fluid to be dispensed). Consequently, more efficient operation can be achieved, resulting in the use of less energy to drive the vibration means.

The 'front' face of the membrane is defined to be the face from which fluid droplets (and/or short fluid jets that subsequently break up into droplets) emerge and the 'rear' face of the membrane is defined to be the face opposite to the front face. The term 'droplets' is intended to include short fluid jets emergent from the front face of perforate forms of membrane that subsequently break up into droplets.

Fluid feed to the membrane may be either to an area of the rear face ('rear face feed') or to an area of the front face ('front face feed') When the membrane is imperforate only front face feed is possible.

Fluid may be supplied directly to a face of the membrane in many different ways.

For example, liquid may be fed to the face of the membrane by a capillary feed which may be of any material form extending from a fluid source into close proximity with the membrane, the capillary having a surface or assembly of surfaces over which liquid can pass from source towards the membrane. Example material forms include open cell foams, fibrous wicks, materials whose surfaces have stripes running substantially in the direction from fluid source towards a membrane with stripes which are of alternately high and low surface energies, materials whose surfaces are roughened with slots or grooves running substantially in the direction from fluid source towards the membrane, paper, cotton thread, and glass or polymeric capillary tubes.

Preferably, such a capillary feed is formed from a flexible material. One example includes a thin leaf spring material placed in near contact with a face of a perforate membrane and a non-perforate continuation of that face extending to the fluid source so to draw liquid by capillary action from the source to the membrane. These flexible forms enable simple arrangements whereby the capillary feed means may be brought into light proximate contact with the membrane so to deliver fluid to that membrane without providing such resistance to the vibratory motion of said membrane that droplet production is prevented.

In applications where relatively high droplet production rates are required, the capillary feed is preferably a relatively open structure so that, perpendicular to the overall fluid flow direction from fluid source to membrane, the ratio of area occupied by capillary material to that area between capillary material surfaces through which fluid may flow is relatively small. Open cell flexible foams and some types of fibrous wick offer both the flexibility and the relatively open structure described above.

As an alternative to capillary feed, individual drops of liquid may be deposited directly onto a face of the membrane, from which membrane the liquid, in droplet form, is then dispensed by the vibration.

A further alternative liquid supply may be achieved by condensing a liquid vapour on one face of the membrane, the liquid thus condensed being dispensed in droplet form as already described.

The membrane may advantageously be perforate, comprising a sheet defining an array of holes through which liquid is dispensed in use. This confers particular advantage for delivery of solutions and some suspensions.

Preferably, the holes defined by a perforate membrane each have a relatively smaller cross-sectional area at the front face and a relatively larger cross-sectional area at the rear face. Hereinafter such holes are referred to as 'tapered' holes. Preferably, the reduction in cross-sectional area of the tapered holes from rear face to front face is smooth and monotonic.

Such tapered holes are believed to enhance the dispensation of droplets. In response to the displacement of the relatively large cross-sectional area of each hole at the rear face of the perforate membrane a relatively large fluid volume is swept in this region of fluid.

Other conditions being fixed, such tapered perforations reduce the amplitude of vibration of the perforated membrane needed to produce droplets of a given size. One reason for such reduction of amplitude being achieved is the reduction of viscous drag upon the liquid as it passes through the perforations. Consequently a lower excitation of the electromechanical actuator may be used. This gives the benefit of improved power efficiency in droplet creation.

Such a benefit is of high importance in battery-powered atomiser apparatus. Further, it reduces the mechanical stresses in the membrane needed for droplet production assisting in reduction of failure rate. Yet further, it enables the use of relatively thick and robust membranes from which satisfactory droplet production can be achieved. Additionally, it enables the successful creation of droplets from liquids of relatively high viscosity with high efficiency.

The tapered perforation may satisfactorily take several geometrical forms, including the form of the frustum of a cone, an exponential cone, and a bi-linear conical taper.

The size of the smaller cross-sectional area of the perforations on the front face of the membrane may be chosen in accordance with the diameter of the droplets desired to be emergent from the membrane. Dependent upon fluid properties and the excitation operating conditions of the membrane, for circular cross-sectional perforation the diameter of the emergent droplet is typically in the range of 1 to 3 times the diameter of the perforation on the droplet-emergent face of the membrane.

Other factors, such as the exact geometrical form of the perforations, being fixed, the degree of taper influences the amplitude of vibration of the membrane needed for satisfactory droplet production from that perforation. Substantial reductions in the required membrane vibrational amplitude are found when the mean semi-angle of the taper is in the range 30 degrees to 70 degrees, although improvements can be obtained outside this range.

For perforate membranes with tapered perforations as described above, it is found that fluid may be fed from the fluid source by capillary feed to a part of the front face of the membrane and in this embodiment fluid is drawn through at least some of the holes in the membrane to reach the rear face of the membrane prior to emission as droplets by the action of the vibration of the membrane by the vibration means. This embodiment has the advantage that, in dispensing fluids that are a multi-phase mixture of liquid(s) and solid particulate components, examples being suspensions and colloids, only those particulates whose size is small enough in comparison to the size of the holes for their subsequent ejection within fluid droplets pass through from the front to the rear face of the perforate membrane. In this way the probability of perforate membrane clogging by particulates is greatly reduced.

The faces of the membrane need not be planar. In particular, for perforate membranes, the front face may advantageously have locally raised regions immediately surrounding each hole. Such locally-raised regions are believed to enhance the dispensation of droplets by more effectively 'pinning' the menisci of the fluid adjacent to the front face of the holes than is achieved by the intersection of the holes with a planar front face of the membrane, and thereby to alleviate problems with droplet dispensation caused by 'wetting' of the front face of the membrane by the fluid.

It is believed that this 'pinning' of the meniscus, inhibiting the 'wetting' of the front face of perforate forms of the membrane employing rear face feed, may alternatively or additionally be achieved by making the front face of the membrane from, or coating it with, fluid repellant material.

Preferably, the membrane, particularly where it is perforate or textured, is formed as a substantially-metallic electro-formed sheet, conveniently from nickel or nickel compounds developed for electroforming, but also from any other electroformable metal or metal compound. Such sheets may be formed to thickness and area limited only by the production process, such that in the present art from each sheet many perforate membranes may be excised. The holes formed in perforate membranes within such sheets may have size and shape determined by an initial photo-lithographic process in combination with the electroforming process, conveniently producing tapered holes and/or regions locally-raised around each hole in the forms described above.

At least in the case of nickel electroforming, gold electroplating may conveniently be used to form a fluid-repellant coating suitable for use with many fluids of the form described above.

The actuator preferably comprises a piezoelectric and/or electrostrictive (hereinafter referred to as an 'electroacoustic') actuator or a piezomagnetic or magnetostrictive (hereinafter referred to as an 'magnetoacoustic') actuator in combination with an electrical (in the case of electroacoustic actuators) or magnetic (in the case of magnetoacoustic actuators) field applied within at least part of the actuator material alternating at a selected frequency. The alternating electrical field may conveniently be derived from an electrical energy source and electronic circuit; the alternating magnetic field may conveniently be derived from an electrical energy source, electronic circuit and magnetically permeable materials.

Advantageously the actuator, particularly within the present state of the electroacoustic actuator manufacturing arts, may be formed as an element responsive by bending to an applied field. Example bending elements are known in the art as 'monomorph', 'unimorph', 'bimorph' and 'multimorph' bending elements. These forms of actuator can provide relatively large amplitudes of vibrational motion for a given size of actuator in response to a given applied alternating field.

This relatively large motion may be transmitted through means bonding together regions of the actuator and the membrane to provide correspondingly relatively large amplitudes of vibratory motion of the membrane, so enhancing droplet dispensation.

The combination of vibration means and membrane is hereinafter referred to as an 'atomising head'.

Preferably, for simplicity of manufacture, the electroacoustic actuator takes the form of an annular disc of piezoelectric and/or electrostrictive ceramic material of substantially constant thickness with a central hole, bonded substantially concentrically to an annular metallic or ceramic (including piezoelectric and electrostrictive ceramics) substrate of comparable mechanical stiffness. By the term 'mechanical stiffness' in this application, we mean the stiffness $Yt^2$, where t is the thickness of the layer. Conventionally stiffness is measured in terms of $Yt^3$, but as the actuator comprises an active layer (i.e., the piezoelectric or electroacoustic material layer) mechanically bonded to a passive layer (the substrate), the appropriate parameter is $Yh^2$. Conveniently, but not necessarily, the outer radius of the substrate annulus may be larger than that of the electroacoustic material bonded to it to facilitate mounting of the actuator. Many other geometrical forms of electroacoustic and magnetoacoustic actuators are possible, including rectangular ones.

Similar actuators in the form of circular discs generally without a central hole are available commercially at low cost, having a wide range of conventional applications as human-audible sound-producing elements. Example suppliers include Murata of Japan and Hoechst CeramTec AG of Lauf, Germany.

To the inner radius of this annual disc or substrate the outer radius of the membrane, in the form of a circular membrane, may be bonded to form the atomising head.

The membrane may by formed integrally with the substrate of the electroacoustic actuator. In the usual case where it is also of the same material as that substrate. This has the advantage that electrolytic corrosion effects between membrane and actuator are avoided.

Such an atomising head possesses a variety of resonant vibration modes that may be characterised by their distribution of vibration amplitudes across the atomising head (and for a given size of atomising head, by the alternating frequencies at which these modes occur) in which the amplitude of vibration of the membrane for a given amplitude of applied alternating field is relatively large. These mode shapes and their characteristic frequencies may be modified by the details of the mounting of the atomising head (if any) and/or by presence of fluid in contact with the membrane and/or actuator. Typically, the modes that are advantageous for dispensation of droplets in the range 1 micrometer to 100 micrometers in diameter are above human-audible frequencies. Droplet production may therefore be achieved virtually silently, which is advantageous in many applications.

Excitation of the preferred mode of vibration of the electroacoustic vibration means may be achieved by means of an electronic circuit, providing alternating electric field within at least part of the electroacoustic material in the region of the frequency at which that mode is excited. Operation in a non-fundamental mode of vibration is preferable.

Advantageously this electronic circuit in combination with the electroacoustic actuator may be "self-tuning" to provide excitation of the preferred vibration mode. Such self-tuning circuits enable a relatively high amplitude of vibration of the preferred mode and therefore relatively efficient droplet production to be maintained for a wide range of droplet dispensation conditions and across large numbers of atomising head and capillary feed assemblies without the need for fine adjustments to adapt each assembly to optimum working conditions. This repeatability is of substantial benefit in large volume, low cost production applications.

'Self-tuning' may be provided by an electronic circuit that is responsive to the motion of the electroacoustic material preferentially to provide gain in the region of the frequency at which the preferred vibration mode is excited. One means by which this may be enabled is the use of a feedback electrode integral with the electroacoustic actuator that provides an electrical output signal dependent upon the amplitude and/or mode shape of vibration of the actuator that influences the operation of the electronic circuit. Examples of such feedback electrodes and self-tuning circuits are well known in the field of disc-form piezoelectric sound-producing elements, although these are usually appropriate only to stimulate resonant vibration in a fundamental or low-order resonant vibration mode. Adaptions of the feedback electrode geometry and/or the bandpass and phase-shifting characteristics of the circuits however, enables 'self-tuning' excitation in selected preferred higher order modes of vibration.

A second example is the use of an electronic circuit responsive to the electrical impedance presented by the electroacoustic amplifier, which impedance changes significantly in the region of resonant modes of vibration.

In some applications, it may be desirable to charge the droplets electrostatically to enable them to be attracted towards the object they are aimed at.

Figure 2A:
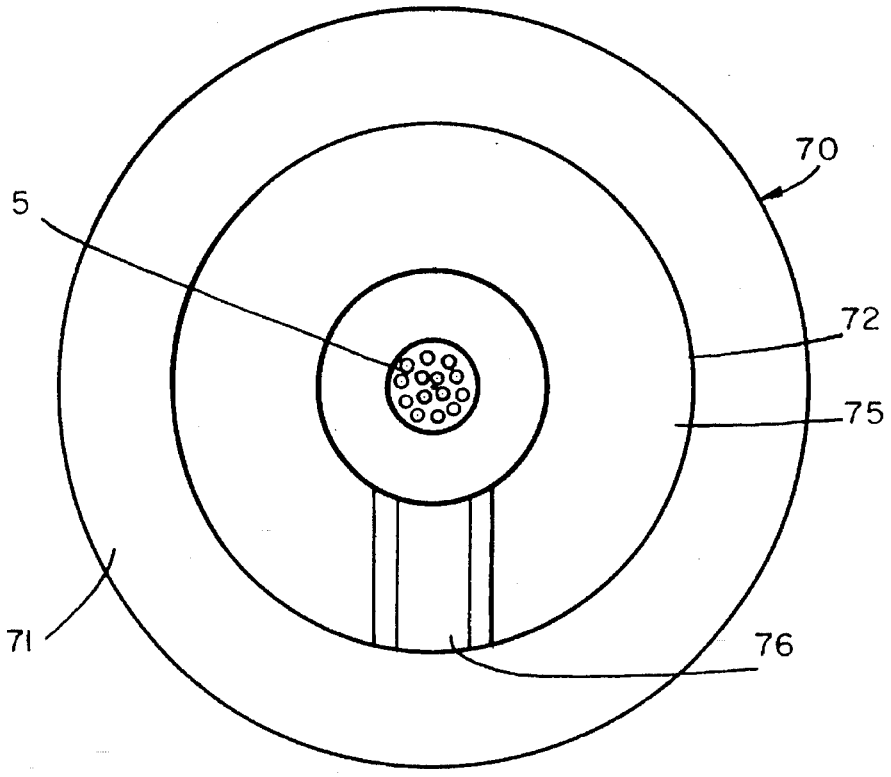
Figure 2B:
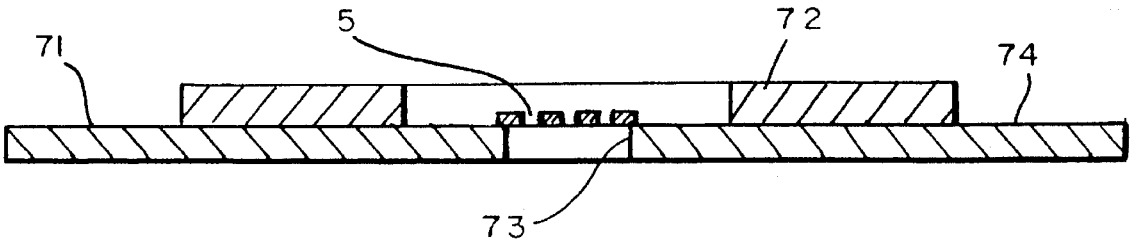

Preferred embodiments of the invention will now be described by way of example only and with reference to the accompanying drawings, in which:

FIG. 1: is a schematic section of a droplet dispensation apparatus;

FIG. 2*a:* is a plan view of a preferred embodiment of an atomising head for such apparatus;

FIG. 2*b:* is a sectional view through the apparatus.

Figure 3:
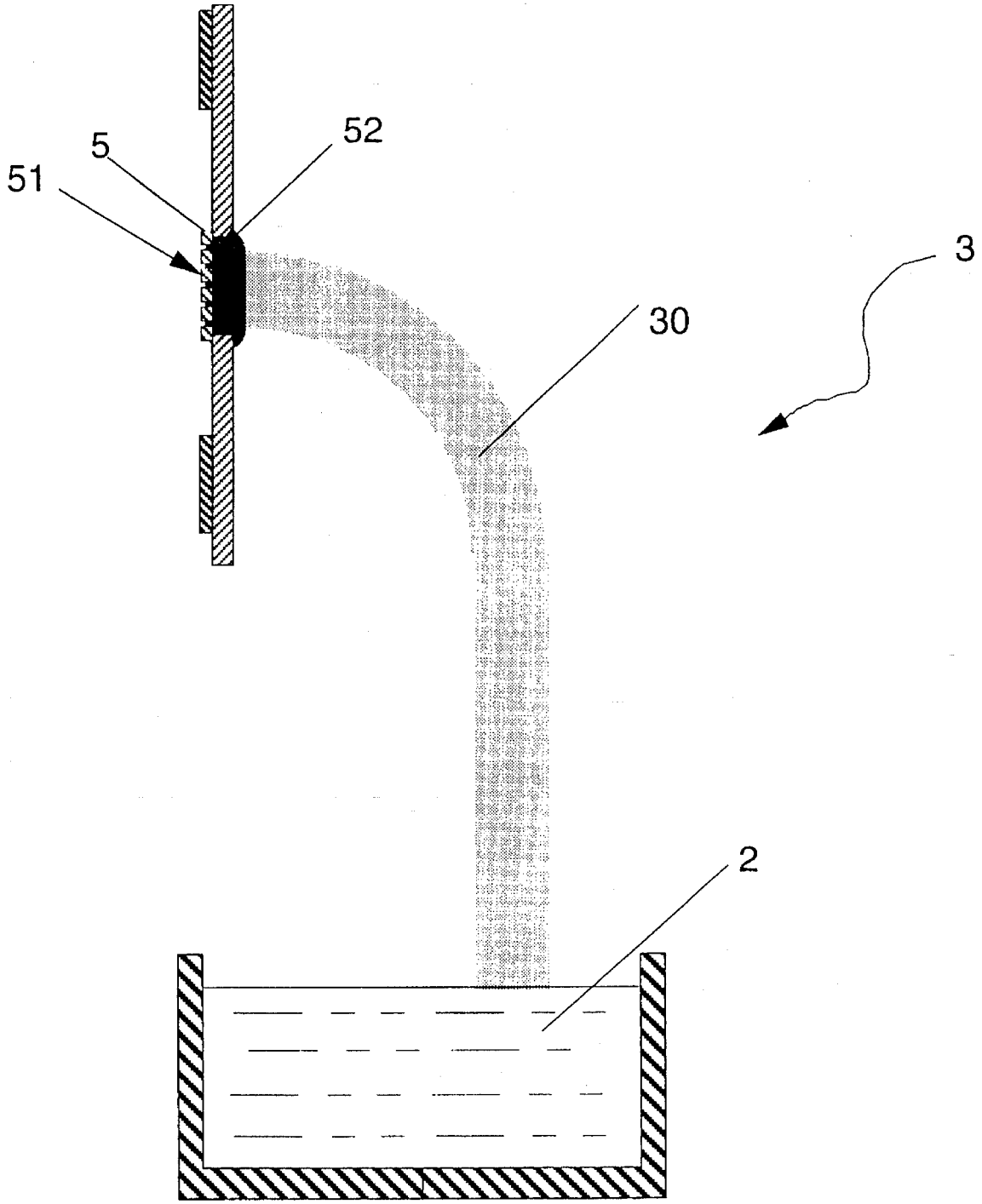
Figure 4:
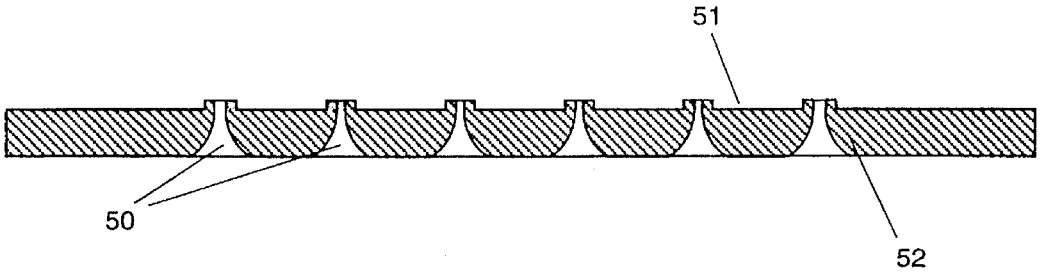
Figure 5:
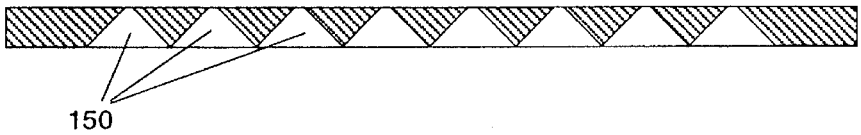
Figure 6:
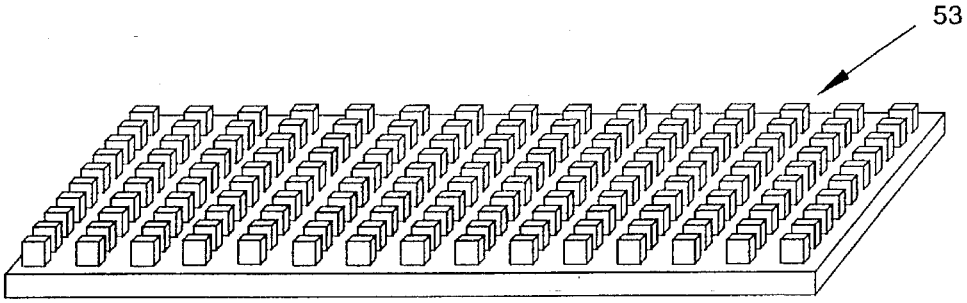
Figure 7:
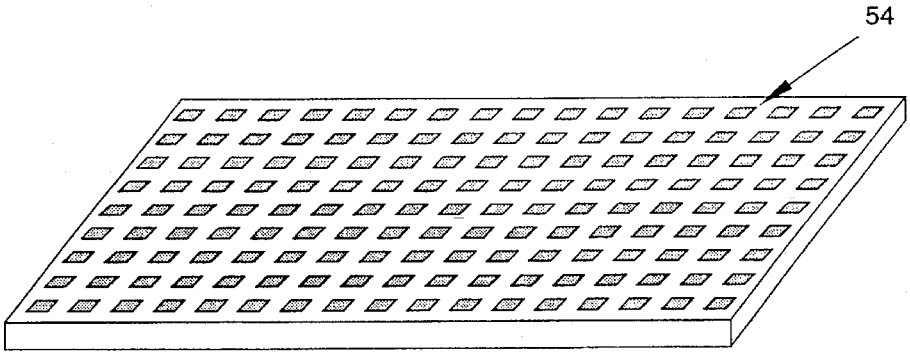
Figure 8:
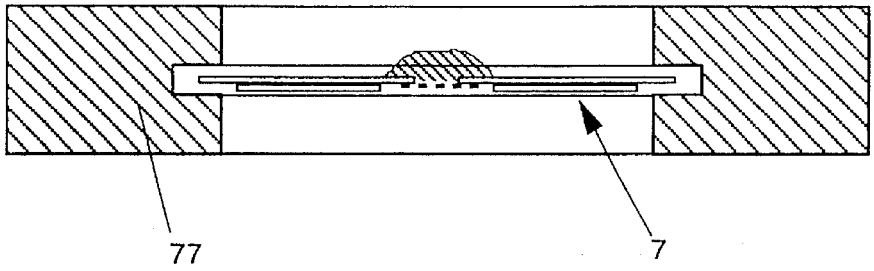

FIG. 3: is a schematic sectional view of a part of the droplet dispensing apparatus incorporating an open cell foam feed;

FIG. 4: illustrates, in section, a preferred form of a perforate membrane used in the embodiment described below;

FIG. 5: illustrates a first alternative membrane structure;

FIG. 6: illustrates a second alternative membrane structure;

FIG. 7: illustrates a third alternative membrane structure;

FIG. 8: shows the mounting of an actuator according to the preferred embodiment;

FIG. 9

FIG. 10 &

Figure 11:
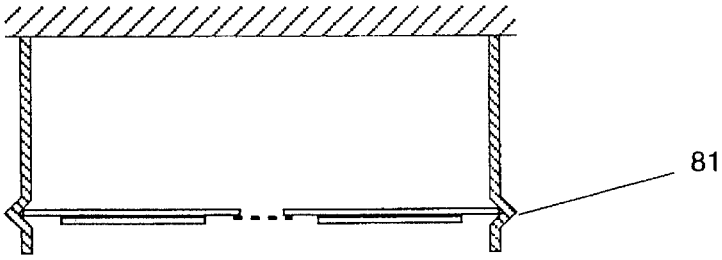
Figure 12:
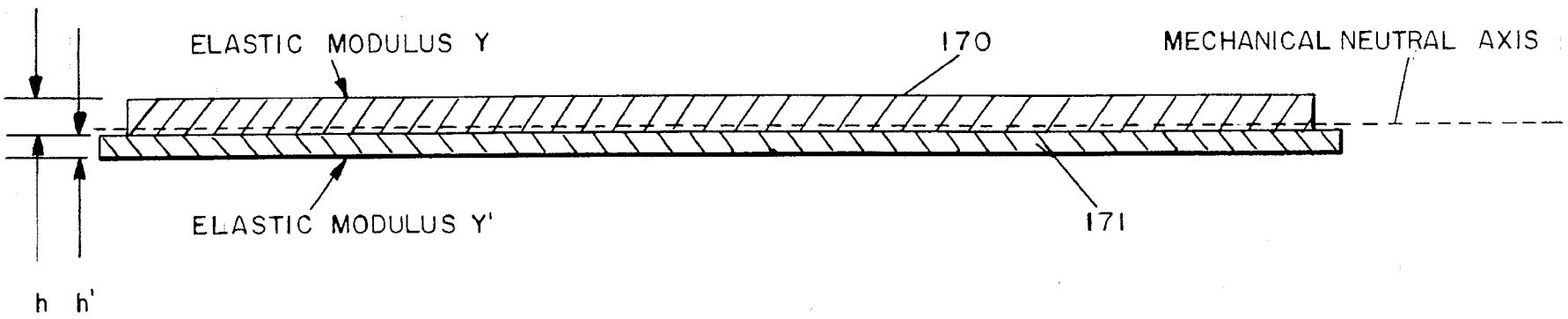

FIG. 11: all show alternative mounting methods;

FIG. 12: illustrates the form of a composite planar actuator as described below with reference to the preferred embodiment; and FIG. 13: is a block circuit diagram for drive electronics of the preferred embodiment.

Figure 13:
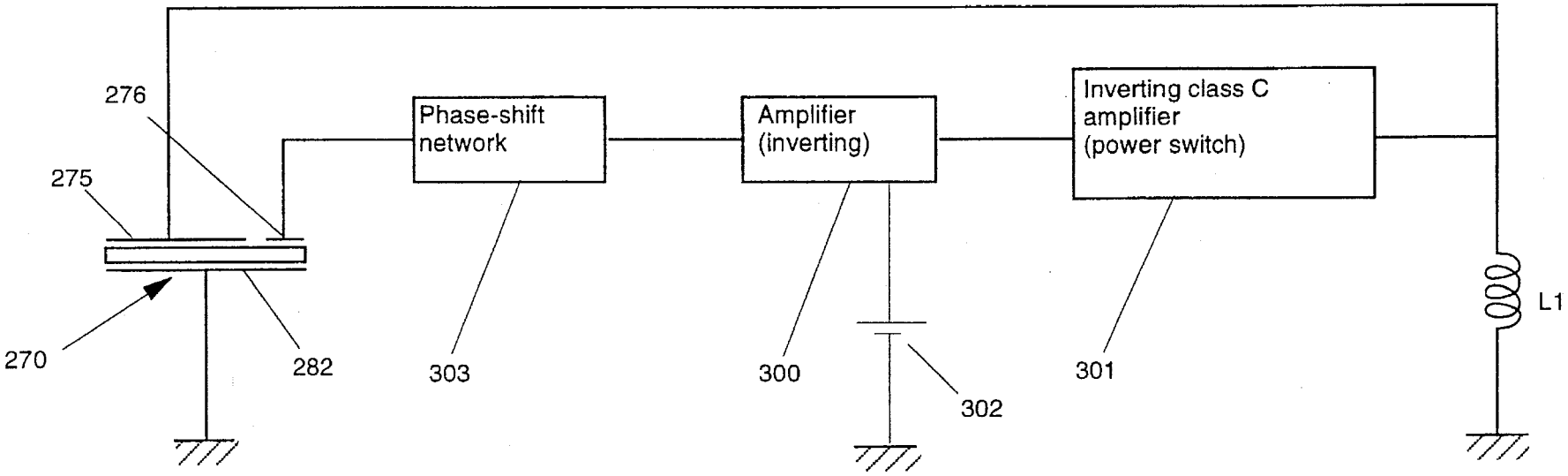
Figure 14:
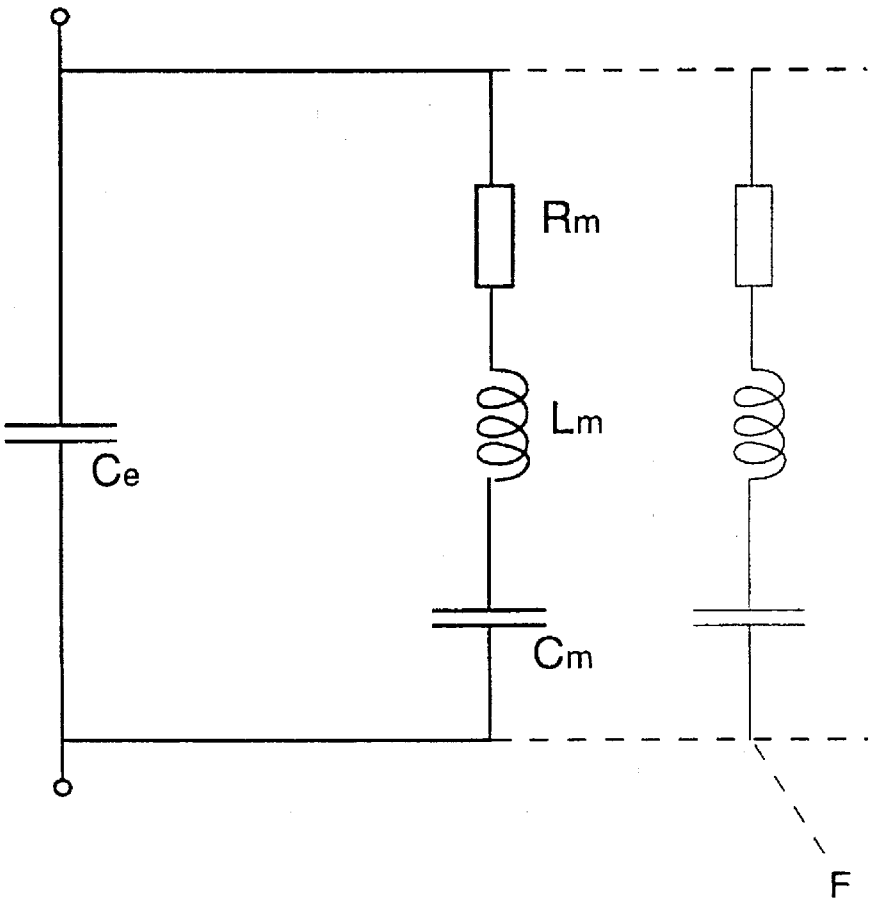

FIG. 14: shows an electrical equivalent circuit for the actuator of FIG. 13.

Figure 15:
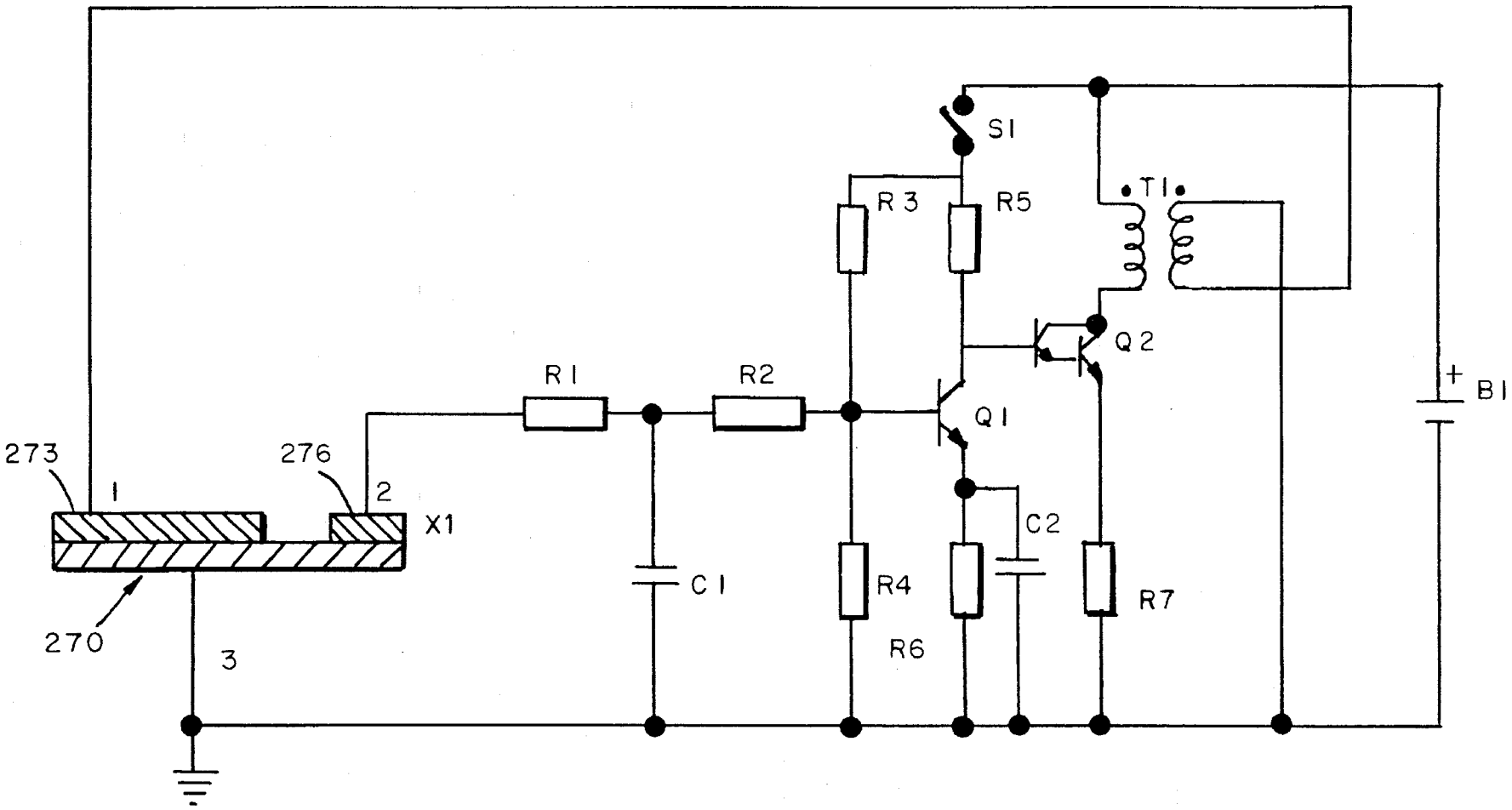

FIG. 15: is a typical low-cost implementation of the circuit of FIG. 13.

Figure 16:
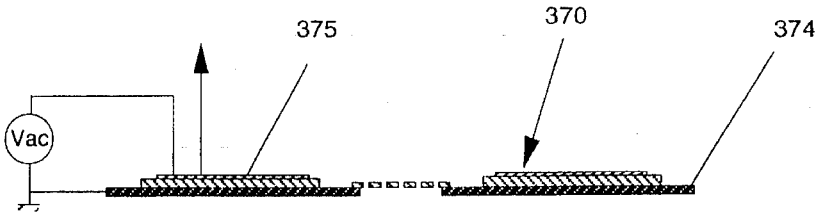
Figure 17:
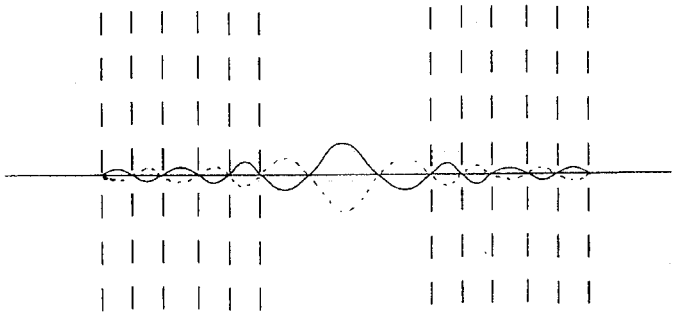

FIG. 16: illustrates an actuator example in cross-section:

FIG. 17: illustrates the positions of the nodes of the higher order bending mode of the same actuator.

Figure 18:
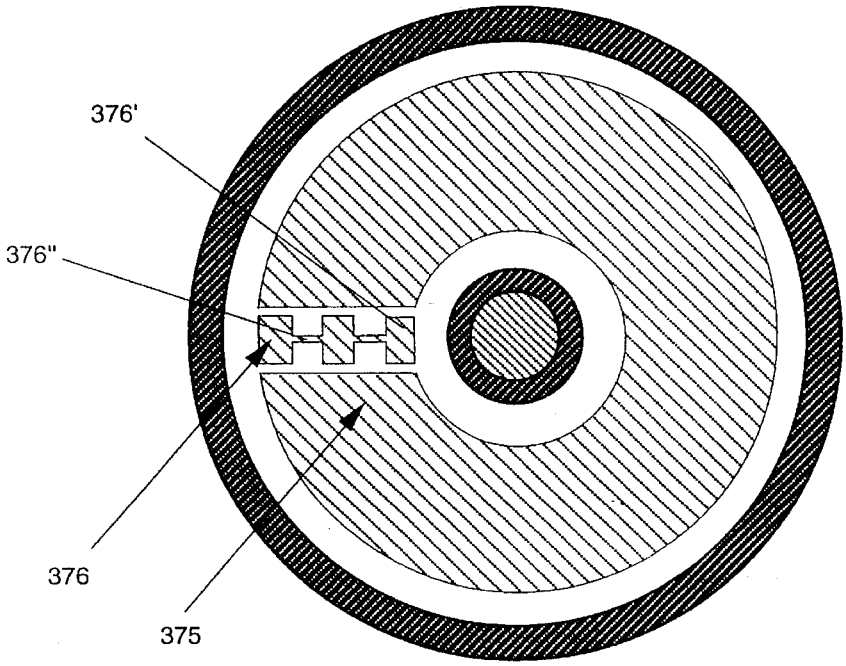

FIG. 18: illustrates the same actuator in plan view.

Figure 19:
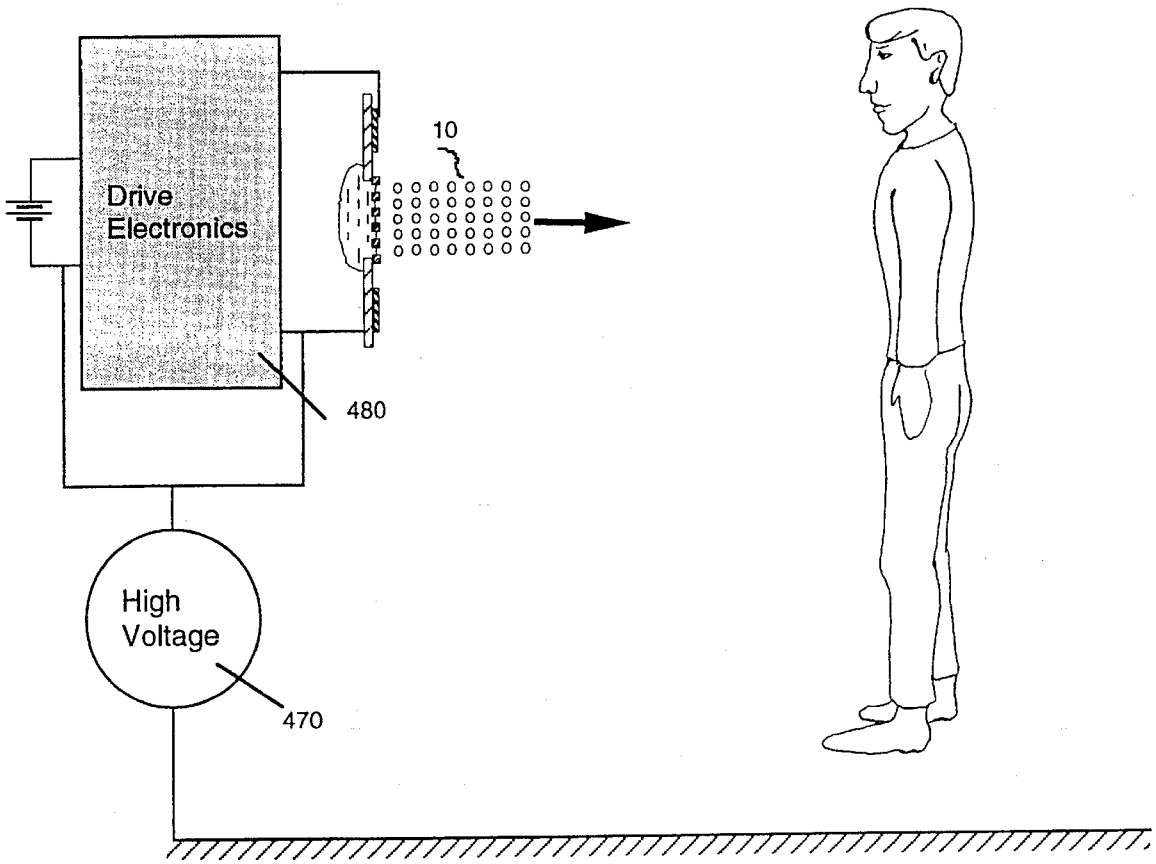

FIG. 19: illustrates, diagrammatically, use of an apparatus of the invention with charging of the droplets.

GENERAL

FIG. 1 illustrates the features of the example broadly and more detail is shown in others of the figures. As FIG. 1 shows, the droplet dispensing apparatus 1 comprises a fluid source 2 from which fluid is brought by capillary feed 3 to the rear face 52 of a perforate membrane 5, and a vibration means or actuator 7, shown by way of example as an annular electroacoustic disc, operable by an electronic circuit 8 which derives electrical power from a power supply 9 to vibrate the perforate membrane 5, producing droplets of fluid 10 from the front face 51 of the perforate membrane.

In an embodiment, preferred for delivery of fine aerosols, the aerosol head consists of a piezoelectric electroacoustical disc 70 comprising a brass annulus 71 to which a piezoelectric ceramic annulus 72 and circular perforate membrane 5 are bonded. The brass annulus has outside diameter 20 mm, thickness 0.2 mm and contains a central concentric hole 73 of diameter 2.5 mm. The piezoelectric ceramic has outside diameter 14 mm, internal diameter 6 mm and thickness 0.2 mm. The upper surface 74 of the ceramic has two electrodes: a drive electrode 75 and a sense electrode 76. The sense electrode 76 consists of a 2 mm wide metallisation that extends radially from the inner to the outer diameter. The drive electrode 75 extends over the rest of the surface and is electrically insulated from the sense electrode by a 0.5 mm air gap. Electrical contacts are made by soldered connections to fine wires (not shown).

The perforate membrane 5 is made from electroformed nickel. It has a diameter of 4 mm and thickness of 20 microns and contains a plurality of tapered perforations 50 (see FIG. 4). These have an exit diameter of 5 microns, entry diameter of approximately 40 microns and are laid out in a lattice with a lattice spacing of 50 microns. Such meshes can be obtained for example from Stork Veco of The Netherlands.

The aerosol head 5,7 is held captured by a grooved annular mounting as described later.

In operation, the drive electrode is driven using a self-resonant circuit at an actuator mechanical resonance close to 400 kHz with an amplitude approximately 25 V. When operating at this mechanical resonance the signal from the sense electrode has a local maximum. The drive circuitry (described in detail later) ensures that the piezo actuator is driven at a frequency close to the 400 kHz resonance with a phase angle between the drive and feedback (or sense) electrodes that is predetermined to give maximal delivery.

Fluid storage and delivery are effected by a foam capillary material 30, such as Basotect, available from BASF. The foam is lightly compressed against the nozzle plate membrane 5.

Membrane

As mentioned above, the membrane 5 is patterned with features. Such feature patterns may take many forms; examples are surface-relief profiles, through-hole profiles, and regions of modified surface energies. Examples are shown in FIGS. 4 through 7. Where such features can influence the menisci of the fluid (at least those menisci on the membrane face from which droplets are emergent) we find generally (at least for perforate forms) that the average droplet size distribution is influenced by the feature dimensions. Greatest influence is generally exerted by the lateral (coplanar with the membrane) dimensions of the features. Typically a feature with a given lateral size will enhance the production of droplets of diameter in the range 2 to 4 times that lateral size.

Particularly preferred is the perforate membrane form of membrane patterning shown by way of example in cross-sectional view in FIGS. 4 and 5 and having holes 50,150 respectively. This is particularly useful for producing fluid droplets from solution fluids and is found to produce well defined droplet distributions with relatively high momentum of the forwardly-ejected droplets. This form may also advantageously be used for producing droplets from suspension fluids where the characteristic linear dimensions of the suspensate particles are typically less than one-quarter the mean diameter of the droplets to be produced. Typically this restricts particulate size to one-half or less that of the perforations. With this form, fluid feed may either be to the front or rear face 51,52 of the membrane.

In some applications it may be advantageous to use unperforated surface-textured membrane forms such as those shown in FIGS. 6 and 7. One example of such an application is in the production of fluid droplets without significant filtration from suspension fluids where the particle dimensions may be more than one-quarter the droplet diameter. The form shown in FIG. 6 incorporates surface relief features 53 that serve to 'pin' menisci of a thin film of fluid introduced onto the surface of the membrane. The form shown in FIG. 7 achieves the same effect with a thin surface layer or treatment that introduces a pattern 54 of high and low surface energies, produced, for example, by appropriate choice of different materials or material treatment, across the membrane. Where the membrane is formed of or is coated with polymer material with relatively low surface energy, for example, polymethylmethacrylate, the membrane surface can be locally exposed to an oxygen-rich plasma to produce local regions of relatively high surface energy. The surface relief feature 53 in FIG. 6 and the pattern 54 in FIG. 7 are shown on one side of the membrane for simplicity. It can be readily appreciated that the same may be provided on both sides if desired.

The relatively high surface energy regions are more readily contacted by fluids of high surface tension than are those of relatively low surface energy, so producing local 'pinned' fluid menisci.

Similarly, membranes may be fabricated from patterns of non-oxidising metal (e.g. gold) deposited on a membrane basal layer of oxidising metal (e.g. aluminium) or similarly of patterns of oxidising metal deposited on a membrane basal layer of non-oxidising metal. We have found that these can also produce local meniscus pinning of fluids.

Further, we find that surfaces patterned with localised regions of differing microscopic roughness can produce the same effect.

With non-perforate forms such as those of FIGS. 6 & 7, fluid feed may only be to the front face of the membrane.

Mounting of actuator

Figure 9:
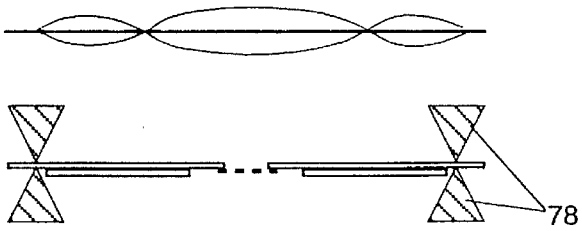
Figure 10:
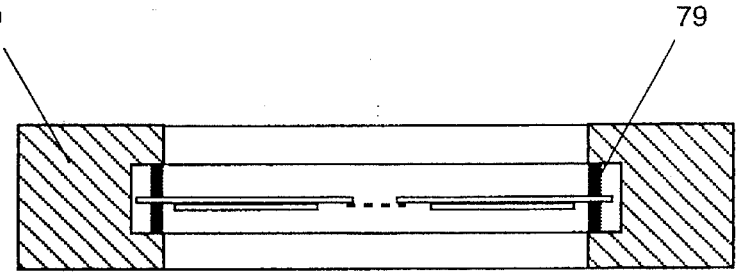

An actuator mounting is unnecessary to establish the bending vibrational motion of the atomising membrane. Where a mounting is provided it is desirable that the mounting does not significantly constrain the actuator bending motion. This can be achieved in a number of ways.

Where any auxiliary feed means do not exert significant force upon the head (for example, the delivery on demand of fluid drops to the rear of the perforate membrane) then the atomising head may simply be 'captured' by an enclosing mounting that nonetheless does not clamp the membrane. An example is shown in FIG. 8. In the embodiment preferred for generation of fine aerosols described above, the actuator 7 is circular and of outside diameter 20 mm and outer thickness 0.2 mm. Referring to FIG. 8, a suitable capturing mounting 77 for this actuator is formed by a fabrication producing, upon assembly, a cylindrical annulus of material whose central circular hole is of diameter 18 mm, containing an annular groove of diameter 22 mm and width 1 mm.

Where auxiliary feed means do exert a significant force upon the head (for example, a capillary wick pressing against the rear of the perforate mesh and/or an actuator layer) then the mounting (together with mechanical coupling from that mounting to components supporting the feed means) must provide the opposing reaction force to maintain the contact. Methods of achieving this without significantly constraining the vibratory bending motion of the head include nodal mounting designs (as shown by way of example in FIG. 9), in which two or more point or line fixings 78 are used. The figure also shows a vibrational mode superimposed above the diagrammatic section. Further alternatives include the use of mountings of compliant material rings 79 (e.g. a closed-cell polymeric foam layer of approximately 1 mm thickness coated on both faces with a thin adhesive coating) supported in a mounting block 80 as shown by way of example in FIG. 10. (Many commercially available self-adhesive foam strips are suitable.) A further alternative is the use of edge mountings 81 by means of which the actuator is merely edge-gripped (as shown by way of example in FIG. 11).

Electroacoustic Actuator

Vibratory excitation of the actuator at appropriate frequencies and adequate amplitudes of the atomising membrane is desired in order to enable fluid atomisation. A bending mode atomiser of the form described, and as shown in detail in FIG. 12, is found to provide this with simple mechanical form, requiring no auxiliary mechanical components and at low cost.

To provide bending motion the actuator should include at least one layer 170 of electrostrictive or magnetostrictive material. This layer (or layers) will be referred to as the 'active' layer(s). [The plural is to be inferred from the singular]. The expansile or contractile motion (in response to an applied electrical or magnetic field) of that 'active' layer should be mechanically constrained by at least one other material layer 171 to which it is mechanically coupled at two or more points and is thus a 'composite' layer structure. The constraint should be such that, as constrained, the remaining expansion or contraction of the active layer is asymmetrically disposed about the mechanical neutral axis of the composite layer structure.

The second material layer 171 (again the plural is to be inferred from the singular) may be a second 'active' layer whose expansile or contractile motion is excited out of phase with that of the first active layer. Alternatively the second layer 171 may be a 'passive' layer of material which is not excited into electrostrictive or magnetostrictive motion by applied electrical or magnetic fields. In either case such second layer will be referred to as a 'reaction' layer.

As in some past designs, if the mechanical stiffness of the reaction layer is very small compared to that of the active layer then the motion of the active layer is relatively unaffected by the reaction layer. In the absence of other mechanical constraints upon the active layer, the expansion or contraction then remains predominantly planar, without exciting significant bending. If the reaction layer stiffness is very large compared to that of the active layer then the motion of the active layer is almost completely suppressed by the reaction layer, so that again very little bending occurs.

To maximise bending motion therefore it is desirable that the thickness and elastic modulus of the 'reaction' layer give it a mechanical stiffness similar to that of the 'active' layer.

For two layer structures of the cross-sectional form shown in FIG. 12, in which the two layers are bonded together by an ideal adhesive layer, effective bending motion is obtained when the following relationship approximately holds:

$$Yh^2 \leqq \alpha Y'h'^2$$

where y=elastic modulus of active layer

Y'=elastic modulus of reaction layer h=thickness of active layer h'=thickness of reaction layer α=a dimensionless constant The term 'mechanical stiffness' in this specification is used to denote $Yh^2$ or $Yh'^2$. Although mechanical stiffness is usually measured in terms proportional to the cube of the thickness of a layer, in the present case it is measured in terms proportional to the square of the thickness of a layer because one of the layers is active.

If the reaction layer is a layer of passive material, then preferably α lies in the range 1 to 10. We have found that values of α between 3 and 4 are especially effective.

If the reaction layer is active, excited into motion to the same degree as, but in antiphase with, the first active layer, then we have found that values of α in the range 0.3 to 10 are effective, 0.3 to 3 particularly effective. One particular example is two piezoelectric layers of similar materials composition and thickness, excited by the same applied alternating electrical potential, but the sign of which potential relative to the electrical polarisation within the two layers is 180° phase-shifted between the two layers.

Electrostrictive and magnetostrictive material layers can be fabricated with inhomogeneous electrostrictive or magnetostrictive properties. In particular the strength of the material response to electrical or magnetic field may vary through the material thickness. Such inhomogeneous layers are functionally identical to the composite layer structures described above and are to be understood as one class of such structures, even though they comprise physically but a single layer.

The thickness of the composite layer structure should be small compared to its plan dimensions in order effectively to excite bending. Preferably, as seen in plan view in FIG. 2 or FIG. 18, the composite layer structure has, within its outer perimeter an orifice (or orifices) 73 across which the atomising membrane 5 (or membranes) extends and to which the atomising membrane is mechanically coupled. It is found generally unsatisfactory to attach a perforate membrane only at a part of the outer perimeter of the composite layer structure.

The outer perimeter and any internal orifices within the composite layer structure are relatively unconstrained. For example they may be of rectangular form, with a wide range of aspect ratios (short side length):(long side length) or of circular form. We have found, for many applications, that a circular annular form of composite layer structure, with perforate membrane extended across a centrally-disposed circular orifice, is highly satisfactory.

Drive Electronics

The piezoelectric actuator and the electronic circuit that has been derived to control it provide the following advantages:

- auto-oscillation at a selectable higher-order resonant bending mode of the actuator;
- closely maximised delivery rate of atomised fluid for given drive voltage level, through accurate automatic drive frequency control;
- insensitivity to manufacturing tolerances of the components within, and assembly of, the atomiser
- efficient use of supplied electrical power, possibly capable of operation from a battery;
- low circuit manufacturing cost.

Self-resonant oscillation of piezoelectric buzzer elements in their fundamental bending mode is well known. Commonly a 'sense' electrode 76,276 is used (see FIGS. 2 & 13), to provide an electronics drive circuit an electrical feedback signal which maximises when the buzzer element oscillates in its fundamental mode.

In the present invention this provision of self-resonant oscillation is extended to excite the particular higher-order bending modes of oscillation found satisfactory for atomisation. This requires discrimination against the strong feedback found in the fundamental mode from a typical buzzer element "sense" electrode and in favour of the typically-weaker feedback found at higher order modes.

In the present example, the selective discrimination of the desired higher order mode is achieved by three steps. Firstly, the electronic drive circuit is adapted to resonate effectively with the electrical capacitance of the piezoelectric actuator only in a limited frequency range around the frequency of the desired mechanical bending resonance. Secondly, a phase-matching circuit is provided to provide the electrical feedback conditions required by the electronic oscillator for it to provide resonant excitation. Thirdly, the sense electrode geometry is adapted to the mode shape of the bending resonance to be selected. (For example; the I.D. and O.D. of the piezo annulus may be chosen to lie on two adjacent nodes, alternatively the width of the electrode can be relatively wide across those parts of the radial section of the bending element in which the instantaneous curvature is positive and relatively narrow across those parts in which the instantaneous curvature is negative, so minimising cancellation).

In combination these steps enable effective self-resonant oscillation of the atomisers' piezoelectric actuator in the desired higher-order bending mode. In turn this enables the atomiser to be relatively insensitive to tolerances in the manufacture of the piezoelectric actuator, to ambient temperature variations, to the effects of fluid loading on the atomiser surface, giving stable atomisation performance. It further enables efficient electrical energy utilisation and a simple, low cost electronic drive circuit.

The electronics drive system will now be described in detail.

FIG. 13 shows a block diagram of the electronics system. The atomiser actuator is shown as 270 with a main upper electrode 275, a supplementary upper "sense" electrode 276, and the substrate with opposite lower electrode 282 is connected to ground. FIG. 14 shows an electrical equivalent circuit for the actuator 270, where Ce represents the static capacitance between main electrode and substrate lower electrode. The actuator device 270 exhibits several mechanically resonant frequencies which result from its dimensions and piezoelectric properties. These can be represented electrically by series R, L, C circuits in parallel with Ce. Rm, Lm, Cm represent one particular resonance. Dispensing of atomised fluid takes place only at certain resonant frequencies. The role of the circuit is to select the one particular resonance that gives optimum dispense (in this case the Lm, Cm resonance). The sense electrode 276 is not shown in FIG. 14: it provides a voltage output signal representing actuator motion.

The circuit of FIG. 13, shown by way of example only, is a phase-shift oscillator—that is the gain around the loop is >1 with phase shift of 360° at a certain frequency—the circuit will oscillate at this frequency. The loop contains the actuator itself. The transfer function of (voltage in to main electrode 275) to (voltage out of sense electrode 276) of the actuator has an important influence on the oscillation of the circuit. The voltage gain of the actuator has local maxima at the mechanical resonances, hence the oscillator circuit could oscillate at any one of these resonant frequencies. Thus some other influence must be brought to bear to reliably force oscillation at the one desired resonance.

This is achieved by adding an inductive element (L1 in FIG. 13) in parallel across the actuator 270. The value of L1 is ideally arranged to be such that the frequency fr at which the actuator is to be driven (i.e. the desired mechanical resonant mode) is the electrical resonant frequency of Ce and L1.

$$\text{i.e. } (2\pi fr)^2 = \frac{1}{L1,Ce} = \frac{1}{Lm,Cm}$$

At frequency fr the impedance of L1 with Ce tends towards infinity, allowing all the electrical power to be applied directly across Rm, Lm, Cm. The presence of L1 across actuator 270 forces the "gain" of the actuator (electrical power in to main electrode, to motion, to signal out from sense electrode) to be greatest at fr. In other words the local gain maximum at fr is emphasised while all others are attenuated. This induces circuit oscillation at a frequency in the region close to fr.

Referring to FIG. 13, there is shown an inverting amplifier 300 providing gain at the desired frequency (which may include frequency response shaping to influence the oscillation frequency), and an inverting switching element 301 which turns on and off at the drive frequency, connecting and disconnecting actuator 270/inductance L1 to/from a dc power source 302.

Around the desired resonance the actuator 270 also exhibits a fast change of phase between the voltage in to the main electrode 275 and the voltage out from sense electrode 276 (relative to the grounded metal substrate). The circuit can operate as an oscillator with the sense electrode 276 connected directly to amplifier 300, in which case the phase shift 275→276 is 0° (360° resulting from amplifier 300 and switch element 301) however it is found that dispensing efficiency varies within the resonance region fr, and that optimum dispensing occurs with phase shift 276→275 of between 45° and 135° (i.e. sense electrode 276 leading). Hence a phase shift network 303 with a corresponding opposite shift (a lag) is inserted as shown to force operation not merely at the chosen resonance but at the optimum dispense condition.

To summarise, the use of an oscillator circuit with the actuator inside the loop using the sense electrode enables automatically tuned accurate dispensing control. The sense electrode response makes circuit oscillation possible at any of a number of resonance points. Using an inductive element in parallel with the actuator selects the desired resonance and, perhaps most significantly, the combination of actuator sense electrode and a phase shift network gives accurate tuning within the resonance for optimum dispense.

In a typical low-cost implementation (FIG. 15) actuator 270 is shown, with a phase shift circuit (R1 and C1) and an inverting transistor amplifier (R2 to R6, C2 and Q1). R2, R3, R4 provide a bias point, R5, R6 give dc gain/bias, with C2 by passing R6 to give higher gain at the operating frequency. Q2 (Darlington transistor, or MOSFET) provides the Class C switch function, with R7 to limit current. The inductive element is provided by transformer T1. The inductance corresponding to L1 in FIG. 13 is provided by the secondary winding of T1, while voltage gain is given by the turns ratio of T1. In this way the resonance frequency selection function is combined with a voltage amplification so that the voltage driven across the main electrode can be many times that derived from the dc power source. DC power is provided by battery B1 and switch S1 can be used to switch the dispensing on and off.

FIGS. 16 to 18 show a particular sense electrode geometry that discriminates in favour of the excitation of the desired higher-order bending mode.

In FIG. 16 is shown a side elevation of a bending mode actuator 370 according to the invention with electroded regions 375 and 376. Electrode 375 is a driven electrode corresponding to element 275 of FIG. 13.

Electrode 376 is a 'sense' electrode, corresponding to element 276 of FIG. 13. Substrate material 374 and piezoelectric material 373 as in FIG. 4.

In FIG. 17 is shown schematically the shape of the desired higher-order bending mode of the actuator of FIG. 16.

In FIG. 18 is shown schematically in plan view the actuator of FIG. 16, including electrodes 375 and 376. Electrode 375 is shown as a simple annular electrode broken only by sense electrode 376. Electrode 375 can advantageously be subdivided into multiple electrodes according to vibration mode shape of the desired mode. Electrode 376 is shown to have relatively wider areas 376' in those radial regions (of the actuator over which it extends) where the curvature has a unitary sign and relatively narrow areas 376" where the curvature is of opposite sign. In this way, at the desired resonant frequency the sense electrode feedback signal is of high magnitude. At other (undesired) resonant frequencies electrode 376 will not match the mode shape so well and will correspondingly attenuate the feedback to some degree.

The drive electronics may alternatively include means for sensing actuator electrical impedance to enable self-tuning.

FIG. 19 shows how electrostatic charge may be provided to the droplets by lifting the drive electronic circuit to a high voltage level above ground by means of a high voltage source 470, so that the droplets 10 are at a high potential when they are emitted under the control of the drive electronics 480. This can be particularly useful for aerosol sprays for personal care fluid products which need to be applied to the skin, but which should not be inhaled into the lungs, the charging of the droplets causing them to be attracted to the user's skin.

We claim:

1. Fluid droplet production apparatus comprising a membrane;

an actuator, for vibrating the membrane, the actuator comprising a composite relatively thin-walled structure arranged to operate in a bending mode having a direction of bending and to vibrate the membrane substantially in the direction of actuator bending; and means for supplying fluid directly to a surface of the membrane, as fluid is sprayed therefrom on vibration of the membrane.

2. Apparatus according to claim 1, wherein the membrane is perforate.

3. Apparatus according to claim 1, wherein the membrane has at least one textured surface.

4. Apparatus according to claim 1, wherein the actuator comprises an electrostrictive piezoelectric, or magnetostrictive member.

5. Apparatus according to claim 4, wherein the member comprises a first layer and the actuator further comprises at least one other layer mechanically bonded to the member.

6. Apparatus according to claim 5, wherein the member has a planar dimension, further including electrodes operatively disposed with respect to the member such that an applied field causes the member to attempt to change length in its planar dimension, whereby mechanical reaction with the other layer causes the actuator bend.

7. Apparatus according to claim 6, wherein the member has a mechanical stiffness $Yh^2$ and the other layer has a mechanical stiffness $Y'h'^2$ which are substantially equal.

8. Apparatus according to claim 7, wherein the mechanical stiffness of the member divided by the mechanical stiffness of the other layer defines a ratio such that which lies in a range of $0.3<\alpha< 10$.

9. Apparatus according to claim 1, wherein the actuator is an annular disc having a central aperture and the membrane is disposed across the central aperture of the disc.

10. Apparatus according to claim 1, wherein the membrane is integrally formed with the composite thin-walled structure of the actuator.

11. Apparatus according to claims 1, wherein fluid is fed to the membrane by means of a capillary feed mechanism.

12. Apparatus according to claim 11, wherein the capillary feed mechanism comprises an open cell foam or fibrous wick.

13. Apparatus according to claim 1, wherein the membrane has a surface and the fluid is fed to the surface of the membrane from which the droplets are dispensed.

14. Apparatus according to claim 1, further including a self-tuning drive circuit to drive the actuator into resonant vibration.

15. Apparatus according to claim 14, wherein the actuator includes a feedback electrode by means of which a feedback signal can be fed back to the drive circuit.

* * * * *